US008863812B2

(12) United States Patent
Lin

(10) Patent No.: US 8,863,812 B2
(45) Date of Patent: Oct. 21, 2014

(54) WINDOW BLIND ASSEMBLY AND CORD GUIDING DEVICE THEREOF

(71) Applicant: Ke-Min Lin, Chiayi (TW)

(72) Inventor: Ke-Min Lin, Chiayi (TW)

( * ) Notice: Subject to any disclaimer, the term of this patent is extended or adjusted under 35 U.S.C. 154(b) by 5 days.

(21) Appl. No.: 13/758,337

(22) Filed: Feb. 4, 2013

(65) Prior Publication Data

US 2014/0216663 A1 Aug. 7, 2014

(51) Int. Cl.
*E06B 9/30* (2006.01)
*E06B 9/24* (2006.01)
*E06B 9/78* (2006.01)

(52) U.S. Cl.
CPC .... *E06B 9/24* (2013.01); *E06B 9/78* (2013.01)
USPC ..... 160/170; 160/173 R; 160/84.05

(58) Field of Classification Search
CPC ..... E06B 9/322; E06B 9/323; E06B 9/307
USPC ..... 160/170, 171, 173 R, 84.04, 84.05, 160/168.1 R, 176.1 R, 177 R, 178.1 R
See application file for complete search history.

(56) References Cited

U.S. PATENT DOCUMENTS 2,860,699 A * 11/1958 Braun ..... 160/173 R
4,488,588 A * 12/1984 McClure ..... 160/178.2
4,662,422 A * 5/1987 Anderson ..... 160/168.1 V
7,025,107 B2 * 4/2006 Ciuca ..... 160/170
7,159,638 B2 * 1/2007 Hsu ..... 160/178.2
7,168,476 B2 * 1/2007 Chen ..... 160/170
7,258,297 B2 * 8/2007 Liu ..... 242/398
7,343,957 B2 * 3/2008 Lin ..... 160/168.1 R
7,624,785 B2 * 12/2009 Yu et al. ..... 160/171
7,665,502 B2 * 2/2010 Dekker ..... 160/168.1 R
7,832,453 B2 * 11/2010 Lin ..... 160/168.1 R
7,866,367 B2 * 1/2011 Liang et al. ..... 160/173 R
7,886,803 B2 * 2/2011 Anderson et al. ..... 160/170
7,913,738 B2 * 3/2011 Fraser et al. ..... 160/115
7,984,745 B2 * 7/2011 Wen et al. ..... 160/170
8,025,089 B2 * 9/2011 Chelednik et al. ..... 160/170
8,156,991 B2 * 4/2012 Cheng et al. ..... 160/178.2
8,365,797 B2 * 2/2013 Drew et al. ..... 160/84.05
8,485,242 B2 * 7/2013 Fraser et al. ..... 160/115
2007/0056692 A1 * 3/2007 Nien et al. ..... 160/168.1 R (Continued)

FOREIGN PATENT DOCUMENTS

TW M338034 8/2011

*Primary Examiner* — Katherine Mitchell
*Assistant Examiner* — Johnnie A Shablack
(74) *Attorney, Agent, or Firm* — Merek, Blackmon & Voorhees, LLC

(57) ABSTRACT

A window blind assembly includes a securing seat, a blind unit, a blind control device and two cord guiding devices interposing the blind control device. Each of the cord guiding devices includes a wheel holder and a guiding wheel. The wheel holder includes a resilient arm unit and two holder walls. Each of the holder walls is formed with an engaging groove having a receiving portion and a constricted portion. The guiding wheel includes two axle portions rotatably and respectively received in the receiving portions of the engaging grooves in the holder walls, and a cord winding portion interconnecting the axle portions and permitting winding of a corresponding cord thereon.

10 Claims, 8 Drawing Sheets

(56) References Cited

U.S. PATENT DOCUMENTS

2007/0102125 A1* 5/2007 Nien et al. ..... 160/178.2
2007/0227677 A1* 10/2007 Yu et al. ..... 160/170
2008/0093035 A1* 4/2008 Hsu et al. ..... 160/176.1 R
2008/0099157 A1* 5/2008 Nien et al. ..... 160/84.05
2008/0264576 A1* 10/2008 Cheng ..... 160/168.1 V
2008/0289774 A1* 11/2008 Ying ..... 160/178.1 R
2012/0227913 A1* 9/2012 Chou ..... 160/176.1 R
2013/0340952 A1* 12/2013 Kao ..... 160/170

* cited by examiner

WINDOW BLIND ASSEMBLY AND CORD GUIDING DEVICE THEREOF

BACKGROUND OF THE INVENTION

1. Field of the Invention

The invention relates to a window blind assembly, more particularly to a window blind assembly with a window blind that is foldable at any desirable position and a cord guiding devices of the window blind assembly.

2. Description of the Related Art

Shown in FIG. 1 is a conventional window blind assembly 1 disclosed in the Taiwanese Utility Model Patent No. M338034 and including a foldable blind 13 that can be folded or stopped at any desirable position. The conventional window blind assembly 1 further includes a securing seat 11 to be mounted on a top rim of a window, a bottom rail 12 spaced apart from the securing seat 11 along a vertical direction and interposing the blind 13 with the securing seat 11, a blind control device 14 for folding upwardly and unfolding downwardly the blind 13, and two cord guiding devices 15 disposed respectively on the left and right sides of the blind control device 14.

The securing seat 11 includes two sidewalls 111 spaced apart from each other, and a bottom wall 112 interconnecting the sidewalls 111 and cooperating with the sidewalls 111 to define an accommodating space 113. The blind control device 14 includes a winding unit 141 mounted in the accommodating space 113, and two cords 142 wound on the winding unit 141, extending through the blind 13 and coupled to the bottom rail 12.

Each of the cord guiding devices 15 includes a mounting plate 151 secured to one of the sidewalls 111 through use of an adhesive, and two guiding rods 152 protruding from the mounting plate 151 for a respective one of the cords 142 to wind thereon. Since the adhesive tends to lose its bonding strength after a period of time, mounting of the cord guiding devices 15 on the securing seat 11 lacks stability.

Although the mounting stability can be elevated with other means, such as by using screw fasteners, in view of the generally narrow design of the accommodating space 113, not only is the mounting operation using screw fasteners itself rather inconvenient, but having to perform the operation of winding the cords 142 within the accommodating space 113 after mounting of the cord guiding devices 15 also proves to be very troublesome.

SUMMARY OF THE INVENTION

Therefore, the object of the present invention is to provide a cord guiding device that has an improved assembly operation for easy and stable mounting of the cord guiding device on a securing seat of a window blind assembly, and to provide a window blind assembly that incorporates the cord guiding device.

According to one aspect of the present invention, there is provided a cord guiding device for a window blind assembly. The window blind assembly includes a securing seat, which includes two sidewalls that are spaced apart from each other and a bottom wall that interconnects the sidewalls and that cooperates with the sidewalls to define the accommodating space. The cord guiding device comprises a wheel holder and at least one guiding wheel. The wheel holder is adapted to be disposed in the accommodating space, and includes a resilient arm unit that is adapted to resiliently abut against the sidewalls of the securing seat so as to mount the wheel holder in the accommodating space, and two holder walls that are connected to the resilient arm unit and that are opposite to each other. Each of the holder walls is formed with at least one engaging groove that has a receiving portion and a constricted portion. The constricted portion serves as an entrance to the engaging groove and has a dimension that is smaller than the receiving portion. The at least one guiding wheel includes two axle portions, each of which is rotatably received in the receiving portion of the at least one engaging groove in a corresponding one of the holder walls after passing through the constricted portion of the at least one engaging groove, and a cord winding portion interconnecting the axle portions and adapted for a cord of the window blind assembly to wound thereon.

According to another aspect of the present invention, there is provided a window blind assembly that comprises a securing seat, a blind unit, at least one blind control device and two cord guiding devices.

The securing seat includes two sidewalls and a bottom wall. The sidewalls are spaced apart from each other, and the bottom wall interconnects the sidewalls and cooperates with the sidewalls to define an accommodating space. The blind unit is disposed below the bottom wall of the securing seat. The blind control device is used to bring the blind unit to fold upwardly and unfold downwardly relative to the securing seat, and includes a winding unit and two cords. The winding unit is disposed in the accommodating space, and each of the cords is wound on the winding unit and has a linking segment that extends from the winding unit and that is coupled to the blind unit.

The cord guiding devices interpose the at least one blind control device, and each of the cord guiding devices includes a wheel holder and at least one guiding wheel.

The wheel holder is mounted in the accommodating space of the securing seat and includes a resilient arm unit and two holder walls. The resilient arm unit resiliently abuts against the sidewalls of the securing seat to mount the wheel holder in the accommodating space, and the holder walls are connected to the resilient arm unit and are opposite to each other. Each of the holder walls is formed with at least one engaging groove that has a receiving portion and a constricted portion. The constricted portion is connected to the receiving portion, serves as an entrance to the engaging groove, and has a dimension that is smaller than the receiving portion.

The guiding wheel includes two axle portions and a cord winding portion. Each of the axle portions is rotatably received in the receiving portion of the at least one engaging groove in a corresponding one of the holder walls after passing through the constricted portion of the at least one engaging groove. The cord winding portion interconnects the axle portions and permits winding of the linking segment of a corresponding one of the cords thereon.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
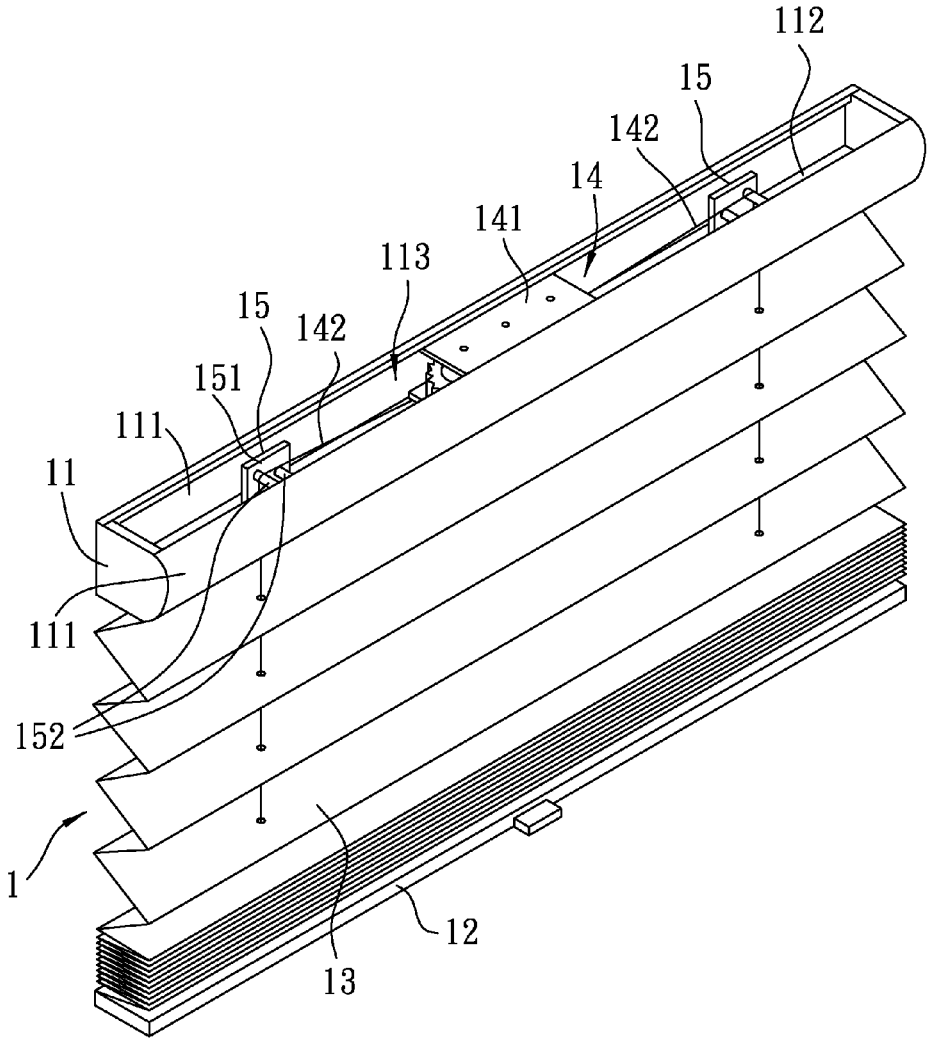
FIG. 1 PRIOR ART
FIG. 1 is an assembled perspective view of a conventional window blind assembly.

Before the present invention is described in greater detail, it should be noted that like elements are denoted by the same reference numerals throughout the disclosure.

Figure 2:
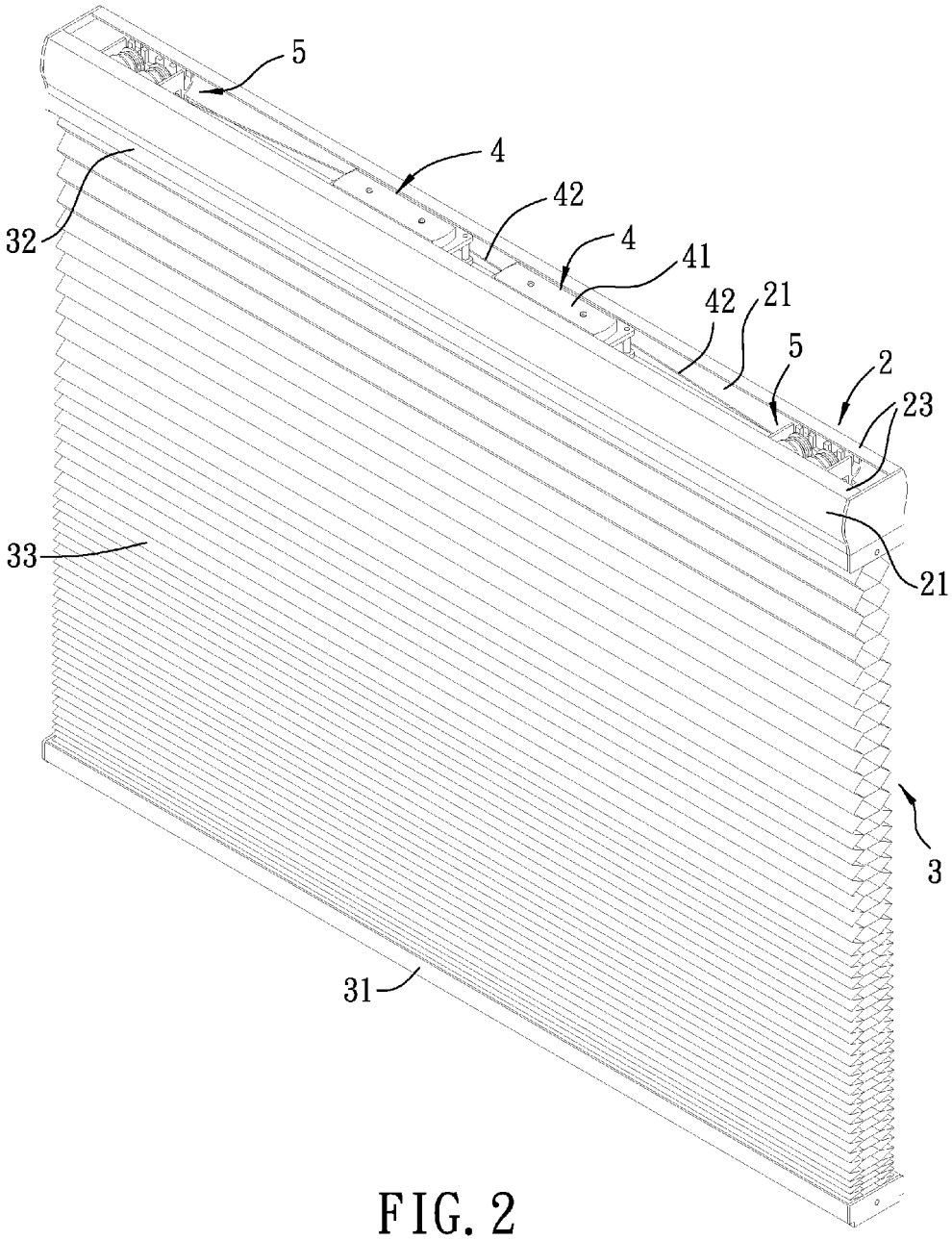
FIG. 2 is an assembled perspective view of a window blind assembly according to the first preferred embodiment of the present invention.

Referring to FIG. 2, a window blind assembly according to the first preferred embodiment of the present invention includes a securing seat 2, a blind unit 3, at least one blind control device 4 and two cord guiding devices 5.

Figure 3:
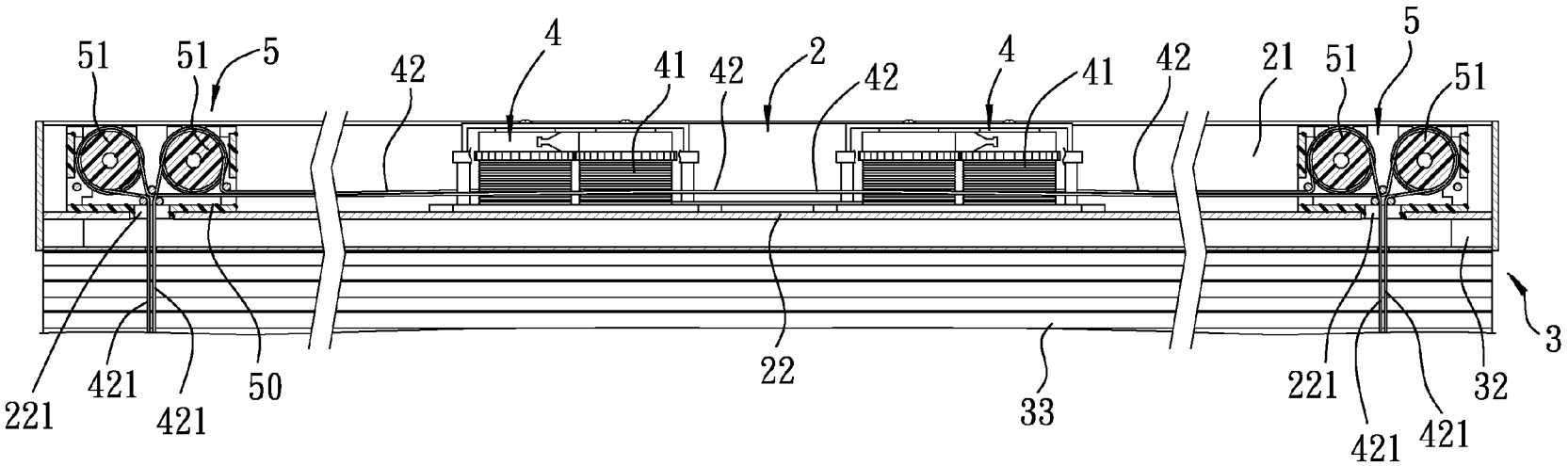
FIG. 3 is a fragmentary front cross-sectional view of the first preferred embodiment.
Figure 4:
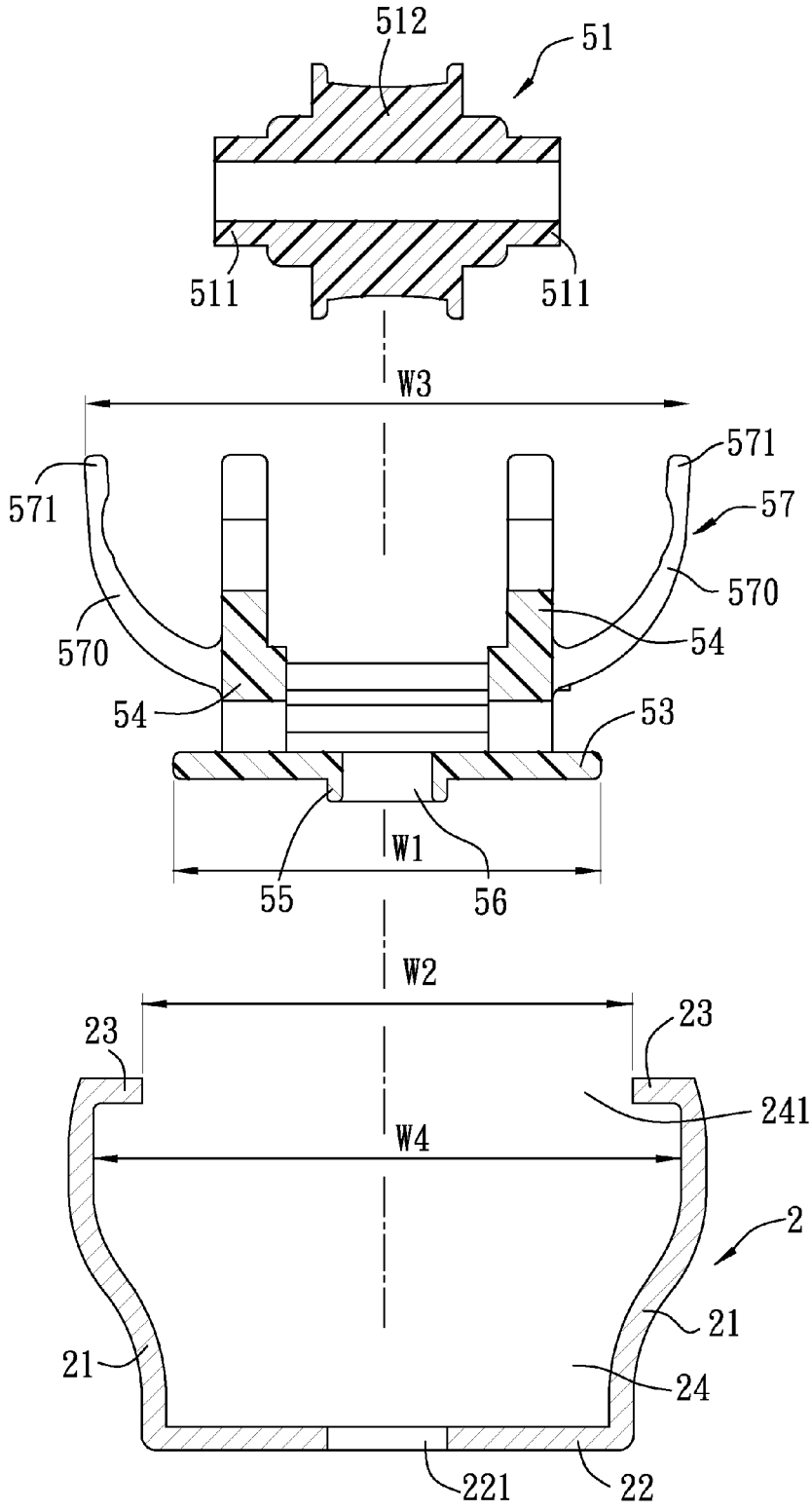
FIG. 4 is an exploded side sectional view for illustrating a cord guiding device and a securing seat of the first preferred embodiment.

As shown in FIGS. 2, 3 and 4, the securing seat 2 includes two sidewalls 21, a bottom wall 22 and two retaining walls 23. The sidewalls 21 are spaced apart from each other in a front-to-rear direction. The bottom wall 22 interconnects the sidewalls 21, is formed with two positioning holes 221, and cooperates with the sidewalls 21 to define an accommodating space 24. The two retaining walls 23 are opposite to the bottom wall in a vertical direction perpendicular to the front-to-rear direction, respectively extend from the sidewalls 21 towards each other, and define therebetween an opening 241 of the accommodating space 24.

The blind unit 3 is disposed below the bottom wall 22 of the securing seat 2, and includes a bottom rail 31, a top rail 32, and a blind 33 that interconnects the bottom rail 31 and the top rail 32. The blind 33 may have a honeycomb-like form as shown in FIG. 2, or may have a "zig-zag" form as shown in FIG. 1, and is not limited to what is disclosed herein.

The blind control device 4 is used to bring the blind unit 3 to fold upwardly and unfold downwardly relative to the securing seat 2, and includes a winding unit 41 that is disposed in the accommodating space 24, and two cords 42. Each of the cords 42 is wound on the winding unit 41, and has a linking segment 421 that extends from the winding unit 41 and through a corresponding one of the positioning holes 221 in the bottom wall 22, the top rail 32 and the blind 33 to be coupled to the bottom rail 31. By balancing the retracting strength of the winding unit 41 with the total weights of the blind 33, the top rail 32 and the bottom rail 31, the blind control device 4 can enable folding of the blind 33 to be stopped at any desirable position. As the operation of the blind control device 4 is well known, and is not where the feature of the present invention lies, further details of the same will be omitted herein.

There is no restriction to the number of blind control devices 4 that can be incorporated to the window blind assembly, as the affecting factors include the weight and width of the blind unit 3. One blind control device 4 is sufficient when a smaller blind unit 3 is used, whereas two, three or even more blind control devices 4 may be preferred when a larger blind unit 3 is used. In the first preferred embodiment, the window blind assembly includes two of the blind control devices 4.

Figure 5:
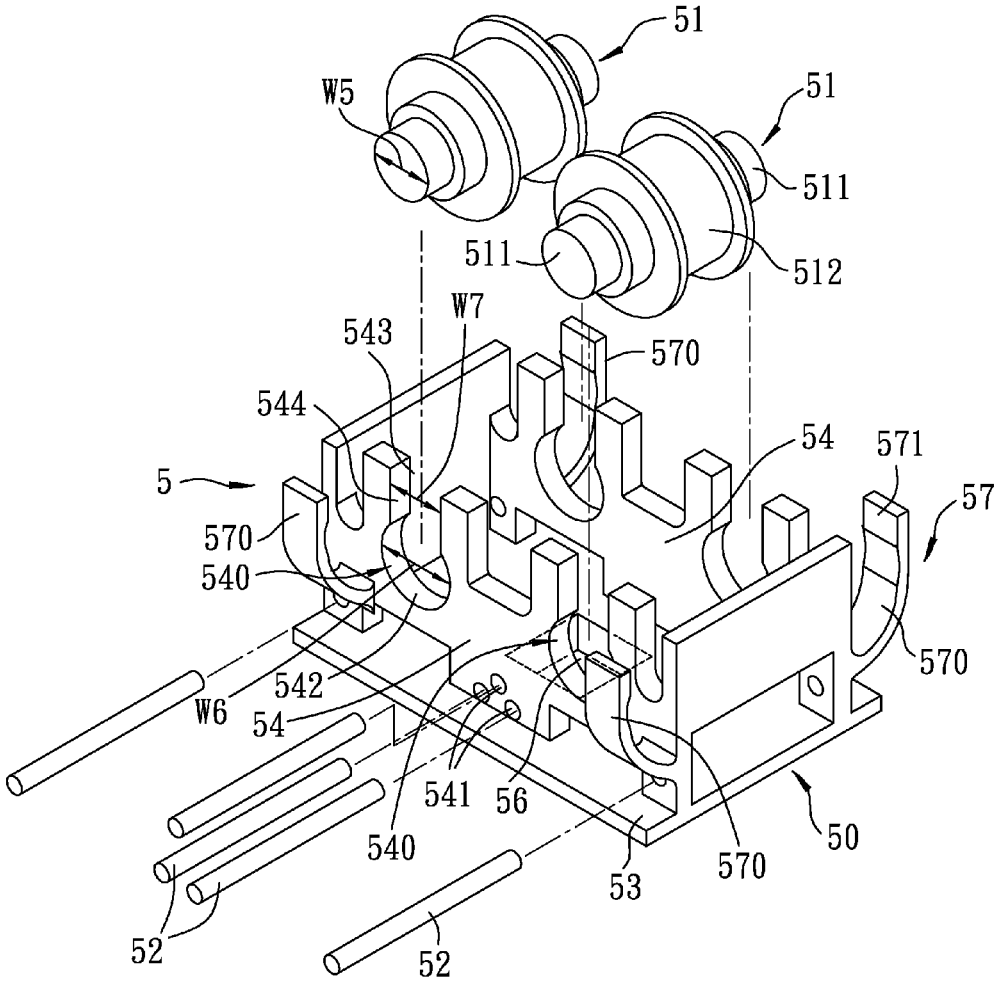
FIG. 5 is an exploded perspective view for illustrating the cord guiding device of the first preferred embodiment.

With further reference to FIG. 5, the cord guiding devices 5 interpose the blind control devices 4, and each of the cord guiding devices 5 includes a wheel holder 50, at least one guiding wheel 51, and a plurality of cord guiding rods 52. The wheel holder 50 is mounted in the accommodating space 24 of the securing seat 2, and includes a base wall 53, two holder walls 54, a positioning projection 55, and a resilient arm unit 57. The wheel holder 50 of each of the cord guiding devices 5 is formed with a hole 56, and a plurality of sockets 541 that have the cord guiding rods 52 respectively inserted therein. The linking segment 421 of each of the cords 42 extends around at least one of the cord guiding rods 52.

Figure 6:
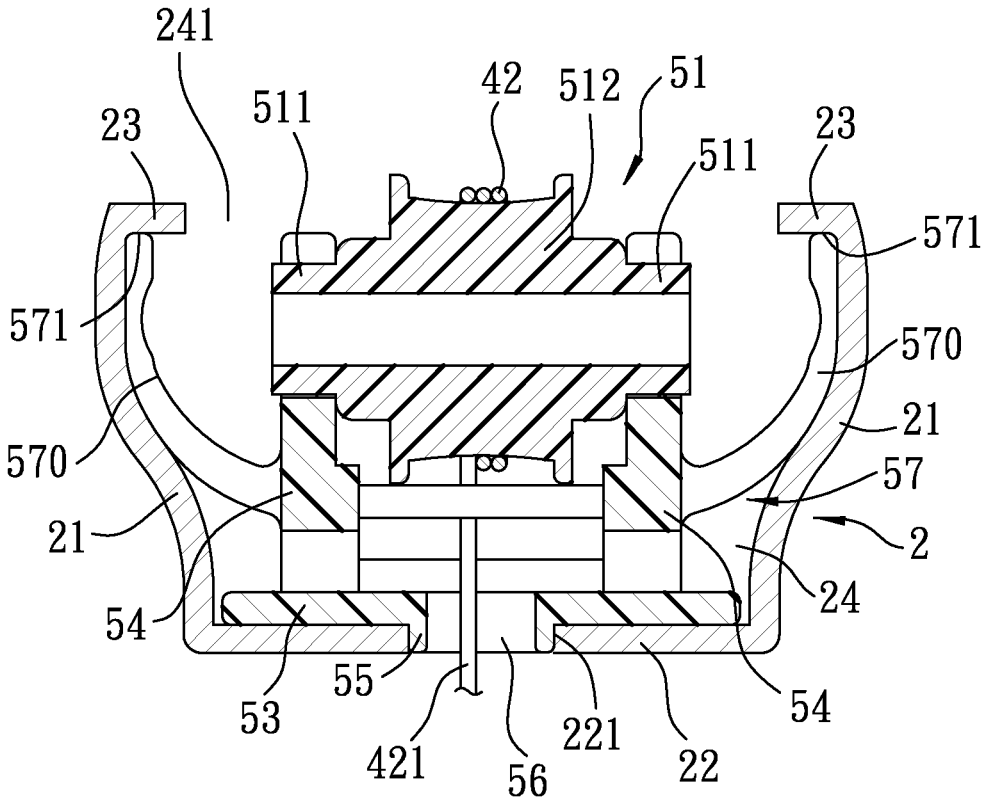
FIG. 6 is a fragmentary assembled side sectional view for illustrating the cord guiding device, the securing seat, and a cord of the first preferred embodiment.

As shown in FIGS. 4, 5 and 6, the holder walls 54 are opposite to each other in the front-to-rear direction, and the resilient arm unit 57 is connected to and extends outwardly from the holder walls 54. Each of the holder walls 54 is formed in the vertical direction with at least one engaging groove 540 that has a circular receiving portion 542 and a constricted portion 544. The constricted portion 544 is connected to the receiving portion 542, serves as an entrance 543 to the engaging groove 540, and has a dimension that is smaller than the receiving portion 542. The base wall 53 interconnects the holder walls 54, and a width (W1) of the base wall 53 in the front-to-rear direction is equal to or smaller than a width (W2) of the opening 241 of the accommodating space 24 in the front-to-rear direction. The positioning projection 55 of each of the cord guiding devices 5 protrudes from the base wall 53 in the vertical direction opposite to the holder walls 54, and engages in a respective one of the positioning holes 221 in the bottom wall 22 of the securing seat 2 for positioning the cord guiding device 5 in the accommodating space 24. The hole 56 in the wheel holder 50 extends through the base wall 53 and the positioning projection 55, and has the linking segment 421 of the corresponding one of the cords 42 extending therethrough. The resilient arm unit 57 resiliently abuts against the sidewalls 21 of the securing seat 2 to mount the wheel holder 50 in the accommodating space 24 and to secure the positioning of the cord guiding device 5 achieved by the engagement of the positioning projection 55 and the respective positioning hole 221. The resilient arm unit 57 includes two pairs of resilient arms 570, where the resilient arms 570 in each pair outwardly and respectively extend from the holder walls 54 and resiliently and respectively abut against the inner sides of the sidewalls 21. When the resilient arms 570 are uncompressed, a maximum distance (W3) in the front-to-rear direction between the resilient arms 570 in each pair is greater than the width (W1) of the base wall 53 and also greater than a maximum distance (W4) in the front-to-rear direction between the inner sides of the sidewalls 21 of the securing seat 2. Moreover, each of the resilient arms 570 has an end portion 571 that abuts against a respective one of the retaining walls 23.

The at least one guiding wheel 51 of each of the cord guiding devices 5 includes two axle portions 511 with circular cross sections, and a cord winding portion 512. Each of the axle portions 511 is rotatably received in the receiving portion 542 of the at least one engaging groove 540 in a corresponding one of the holder walls 54 after passing through the constricted portion 544 of the at least one engaging groove 540. A radial diameter (W5) of each of the axle portions 511 is equal to a radial diameter (W6) of the receiving portion 542, and greater than a width (W7) of the constricted portion 544 in a sideways direction perpendicular to the front-to-rear and vertical directions. The cord winding portion 512 interconnects the axle portions 511 and permits winding of the linking segment 421 (as shown in FIG. 3) of a corresponding one of the cords 42 thereon.

Referring to FIG. 3, in this first preferred embodiment, each of the two cord guiding devices 5 includes two of the guiding wheels 51, and each of the holder walls 54 of each of the cord guiding devices 5 is formed with two of the engaging grooves 540 respectively corresponding to the two guiding wheels 51. As discussed above, there are two blind control devices 4 in the first preferred embodiment, each of which includes two cords 42. The linking segments 421 of the cords 42 of each of the blind control devices 4 are respectively wound around the cord winding portion 512 of one of the guiding wheels 51 of one of the cord guiding devices 5 and the cord winding portion 512 of one of the guiding wheels 51 of the other cord guiding device 5. For example, one of the cords 42 of the left blind control device 4 extends towards and winds around one of the guiding wheels 51 of the left cord guiding device 5, and one of the cords 42 of the right blind control device 4 extends towards and winds around the other of the guiding wheels 51 of the left cord guiding device 5. The other of the cords 42 of the left blind control device 4 extends towards and winds around one of the guiding wheels 51 of the right cord guiding device 5, and the other of the cords 42 of the right blind control device 4 extends towards and winds around the other of the guiding wheels of the right cord guiding device 5. In other words, overall, two cords 42, one from each of the blind control devices 4, extend towards each other and cross each other between the two blind control devices 4 to each be subsequently wound around a guiding wheel 51 of the farther cord guiding device 5.

To make it clear, the number of the positioning holes 221 formed in the bottom wall 22 of the securing seat 2 corresponds to the number of the cord guiding devices 5, and the total number of the guiding wheels 51 corresponds to the total number of the cords 42.

Referring to FIGS. 2, 3, 4 and 6, to assemble the window blind assembly of the first preferred embodiment, the winding units 41 of the blind control devices 4 are mounted in the accommodating space 24 of the securing seat 2 proximate to the center of the accommodating space 24. The wheel holders 50 of the cord guiding devices 5 are downwardly pressed into the accommodating space 24 through the opening 241. Since the distance (W3) between the resilient arms 570 in each pair is greater than the width (W2) of the opening 241 of the accommodating space 24, and by virtue of resiliency of the resilient arms 570, when the wheel holder 50 of each of the cord guiding devices 5 is downwardly pressed into the accommodating space 24 through the opening 241, the resilient arms 570 are compressed towards each other in the front-to-rear direction until the resilient arms 570 are completely received in the accommodating space 24 and until the positioning protrusion 55 of the wheel holder 50 is engaged with the corresponding one of the positioning holes 221 in the base wall 22 of the securing seat 2, at which time the restoring forces accumulated in the resilient arms 570 urge the resilient arms 570 to abut against the inner sides of the sidewalls 21. After assembly, the end portions 571 of the resilient arms 570 respectively abut against the corresponding retaining walls 23 of the securing seat 2, and the wheel holders 50 are firmly and stably mounted in the accommodating space 24.

Referring to FIGS. 2, 3, 5 and 6, depending on different applications, the linking segment 421 of each of the cords 42 may be wound on the corresponding one of the guiding wheels 51 of the corresponding one of the cord guiding devices 5 for one or more laps, while extending around one or more of the cord guiding rods 52 before and/or after winding on the corresponding guiding wheel 51, and subsequently extends through the hole 56 in the wheel holder 50 of the corresponding cord guiding device 5, through the top rail 32 and the blind 33 to be steadily coupled with the bottom rail 31. Having the cords 42 wound thereon, each guiding wheel 51 is then pressed downwards so that the axle portions 511 thereof are received in the corresponding engaging grooves 540 in the holder walls 54 of the wheel holder 50. Since the radial diameter (W5) of the axle portions 511 is equal to the radial diameter (W6) of the receiving portions 542 of the corresponding engaging grooves 540, but greater than the width (W7) of the constricted portions 544 of the corresponding engaging grooves 540, once the axle portions 511 respectively pass through the constricted portion 544 and respectively into the receiving portions 542, the axle portions 511 are stably and rotatably received in the receiving portions 542, thereby completing the assembly of the window blind assembly according to the first preferred embodiment.

Figure 7:
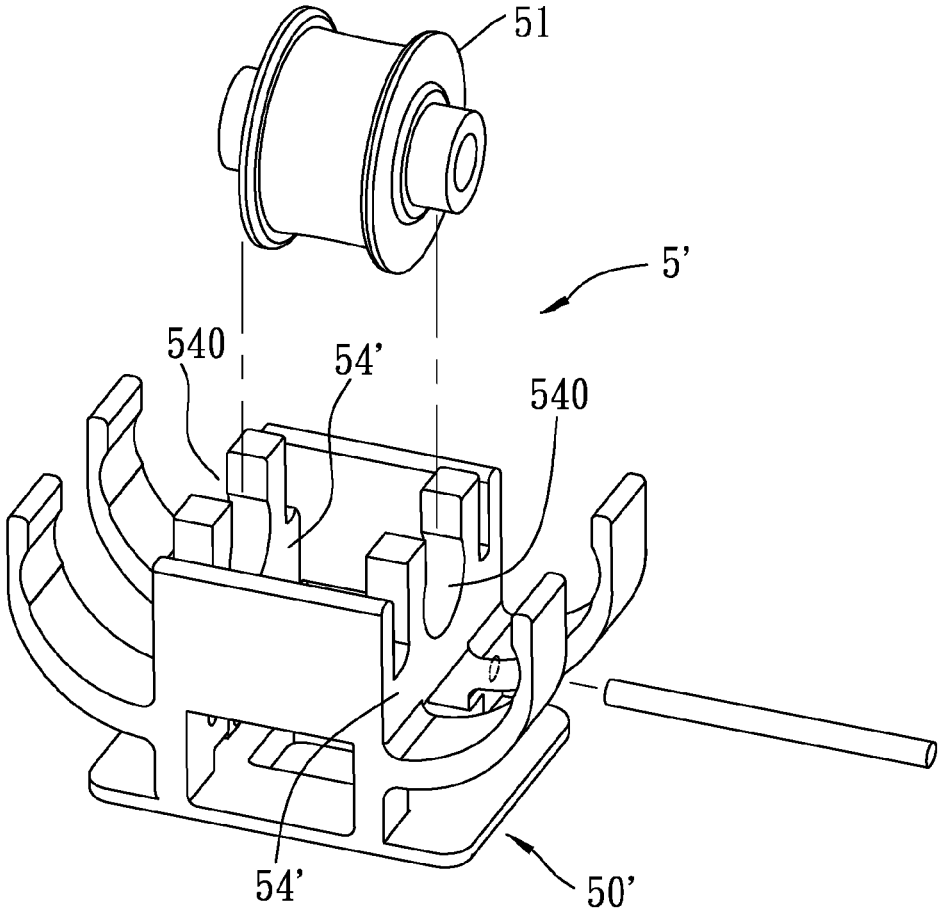
FIG. 7 is an exploded perspective view for illustrating a cord guiding device according to the second preferred embodiment of the present invention.

Referring to FIG. 7, the second preferred embodiment according to the present invention only differs from the first preferred embodiment in that each cord guiding device 5' includes only one guiding wheel 51 and that each of the holder walls 54' of the wheel holder 50' is formed with only one engaging groove 540.

Figure 8:
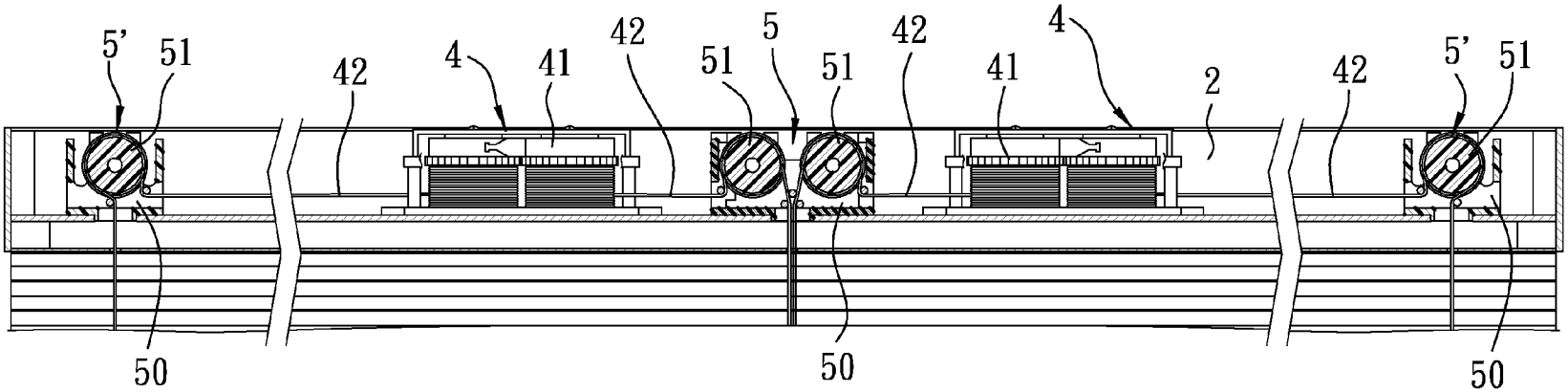
FIG. 8 is a fragmentary front cross-sectional view for illustrating a window blind assembly according to the third preferred embodiment of the present invention.

Referring to FIG. 8, the structure of a window blind assembly according to the third preferred embodiment of the present invention is similar to that of the first preferred embodiment, and only differs in that the window blind assembly of the third preferred embodiment includes three cord guiding devices 5, 5', one of which has the structure described in the first preferred embodiment (including two guiding wheels 51) and is disposed between the winding units 41 of the blind control devices 4, and the remaining two of which each has the structure described in the second preferred embodiment (including one guiding wheel 51) and are respectively disposed at sides of the winding units 41 opposite to the one with the structure of the first preferred embodiment.

In other words, as long as each blind control device 4 is interposed by two cord guiding devices 5, 5' in any of the alternative arrangements so that the two cords 42 thereof can extend in opposite directions and be each wound on a guiding wheel 51, the window blind assembly of the present invention may include any number of the different types of cord guiding devices 5, 5'. In addition, there is no limitation as to the number of laps that each cord 42 can be wound around the corresponding guiding wheel 51. The cord guiding device 5, 5' of this invention can be used in window blind assemblies of various sizes.

In summary, when assembling the cord guiding devices 5, 5' and the cords 42 to the securing seat 2 according to the present invention, the wheel holders 50, 50' can be easily mounted into the accommodating space 24 of the securing seat 2 through a simple downward pressing action, and once the guiding wheels 51 have the respective cords 42 wound thereon, the guiding wheels 51 can also be easily installed on the wheel holders 50, 50' through one simple downward pressing action, thereby conveniently and securing completing the assembly process, while eliminating the instability problem encountered in the prior art.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A window blind assembly comprising:

a securing seat including two sidewalls that are spaced apart from each other, and a bottom wall that interconnects said sidewalls and that cooperates with said sidewalls to define an accommodating space;

a blind unit disposed below said bottom wall of said securing seat;

at least one blind control device for bringing said blind unit to fold upwardly and unfold downwardly relative to said securing seat, and including a winding unit that is disposed in said accommodating space, and two cords, each of said cords being wound on said winding unit and having a linking segment that is coupled to said blind unit; and two cord guiding devices interposing said at least one blind control device;

wherein each of said cord guiding devices includes a wheel holder mounted in said accommodating space of said securing seat, and at least one guiding wheel, said wheel holder including a resilient arm unit that resiliently abuts against said sidewalls of said securing seat so as to mount said wheel holder in said accommodating space, and two holder walls that are connected to said resilient arm unit and that are opposite to each other, each of said holder walls being formed with at least one engaging groove that has a substantially circular receiving portion and a constricted portion connected to said receiving portion, said constricted portion serving as an entrance to said engaging groove and having a dimension that is smaller than said receiving portion, said at least one guiding wheel including two axle portions, each of which extends in a front-to-rear direction and is rotatably received in said receiving portion of said at least one engaging groove in a corresponding one of said holder walls after passing through said constricted portion of said at least one engaging groove, and a cord winding portion which interconnects said axle portions and permits winding of said linking segment of a corresponding one of said cords thereon, a radial diameter of each of said axle portions being equal to a radial diameter of said receiving portion, and greater than a width of said constricted portion in a sideways direction perpendicular to the front-to-rear direction.

2. The window blind assembly as claimed in claim 1, wherein each of said holder walls is formed with a plurality of sockets, and said cord guiding device further includes a plurality of cord guiding rods respectively inserted in said sockets, said linking segment of each of said cords extending around at least one of said cord guiding rods.

3. The window blind assembly as claimed in claim 1, wherein:

said securing seat further includes two retaining walls opposite to said bottom wall, respectively extending from said sidewalls towards each other, and cooperatively defining therebetween an opening of said accommodating space; and said resilient arm unit includes at least a pair of resilient arms abutting respectively and resiliently against inner sides of said sidewalls and each having an end portion that abuts against a respective one of said retaining walls.

4. The window blind assembly as claimed in claim 3, wherein a distance between said two resilient arms of said resilient arm unit when the resilient arms are uncompressed is greater than a distance between said inner sides of said sidewalls.

5. The window blind assembly as claimed in claim 1, wherein:

said bottom wall of said securing seat is formed with two positioning holes; and said wheel holder of each of said cord guiding devices further includes a base wall interconnecting said holder walls, and a positioning projection protruding from said base wall opposite to said holder walls, and engaging in a respective one of said positioning holes, said wheel holder being formed with a hole that extends through said base wall and said positioning projection, and that has said linking segment of the corresponding one of said cords extending therethrough.

6. The window blind assembly as claimed in claim 5, wherein said window blind assembly comprises two of said blind control devices, each of said cord guiding devices including two of said guiding wheels, each of said holder walls of each of said cord guiding devices being formed with two of said engaging grooves respectively corresponding to said two guiding wheels of said cord guiding device, said linking segments of said cords of each of said blind control devices being respectively wound around said cord winding portion of one of said guiding wheels of one of said cord guiding devices and said cord winding portion of one of said guiding wheels of the other of said cord guiding devices.

7. The window blind assembly as claimed in claim 5, wherein:

said blind unit includes a bottom rail, a top rail, and a blind connected between said bottom rail and said top rail; and said linking segment of each of said cords extends through said hole in said wheel holder, said upper rail and said blind, and is coupled to said bottom rail.

8. A cord guiding device for a window blind assembly, the window blind assembly including a securing seat, the securing seat including two sidewalls that are spaced apart from each other and a bottom wall that interconnects the sidewalls and that cooperates with the sidewalls to define the accommodating space, said cord guiding device comprising:

a wheel holder adapted to be disposed in the accommodating space, and including a resilient arm unit that is adapted to resiliently abut against the sidewalls of the securing seat so as to mount the wheel holder in the accommodating space, and two holder walls that are connected to said resilient arm unit and that are opposite to each other, each of said holder walls being formed with at least one engaging groove that has a receiving portion and a constricted portion, said constricted portion serving as an entrance to said engaging groove and having a dimension that is smaller than said receiving portion; and at least one guiding wheel including two axle portions, each of which is rotatably received in said receiving portion of said at least one engaging groove in a corresponding one of said holder walls after passing through said constricted portion of said at least one engaging groove, and a cord winding portion interconnecting said axle portions and adapted for a cord of the window blind assembly to wound thereon.

9. The cord guiding device as claimed in claim 8, wherein said resilient arm unit of said wheel holder includes two resilient arms adapted to respectively and resiliently abut against inner sides of the sidewalls, and a distance between said resilient arms when said resilient arms are uncompressed is greater than a distance between the inner sides of the sidewalls.

10. The cord guiding device as claimed in claim 8, wherein said cord guiding device includes two of said guiding wheels, each of said holder walls being formed with two of said engaging grooves respectively corresponding to said guiding wheels.

* * * * *